United States Patent [19]

Hulber et al.

[11] Patent Number: 4,486,111

[45] Date of Patent: Dec. 4, 1984

[54] DATA BINDER SLIDE

[75] Inventors: Loren J. Hulber, Edina, Minn.; William D. Stuertz, Glenview, Ill.

[73] Assignee: Jostens, Inc., Minneapolis, Minn.

[21] Appl. No.: 426,714

[22] Filed: Sep. 29, 1982

[51] Int. Cl.[3] ..... B42F 13/00

[52] U.S. Cl. ..... 402/17; 402/80 P; 402/16; 402/65

[58] Field of Search ..... 402/16, 17, 65, 68, 402/14, 15, 80 P, 13, 64

[56] References Cited

U.S. PATENT DOCUMENTS

| | | | |
|---|---|---|---|
| 1,557,279 | 10/1925 | Van Valkenburgh | 402/65 |
| 3,121,432 | 2/1964 | Schade | 402/16 |
| 3,263,689 | 8/1966 | Lindgren et al. | 402/17 |
| 3,628,877 | 12/1971 | Barnes, Jr. | 402/17 |
| 3,706,502 | 12/1972 | La Fleur | 402/17 |
| 3,776,648 | 12/1973 | Price | 402/17 |
| 3,957,321 | 5/1976 | Rose | 312/184 |
| 4,121,892 | 10/1978 | Nes | 402/17 |
| 4,302,123 | 11/1981 | Dengler et al. | 402/17 X |

FOREIGN PATENT DOCUMENTS

| | | | |
|---|---|---|---|
| 11819 | 6/1980 | European Pat. Off. | 402/65 |

*Primary Examiner*—Paul A. Bell

[57] ABSTRACT

A data binder having compression bars forming longitudinal rails and a center channel, flexible posts securing data sheets between compression bars and a retaining slide member embracing the rails to hold the bent over posts in place. Each end of said retaining slide member includes a flare at the end of the center groove for receiving the post. The guide groove facilitates insertion of the post into the retaining slide member.

3 Claims, 5 Drawing Figures

DATA BINDER SLIDE

DESCRIPTION

BACKGROUND OF THE INVENTION

1. Field of the Invention

This invention relates to flexible post binders for file folders and is more particularly concerned with an improvement in locking flexible posts using slide members.

2. Description of the Prior Art

Typical print-out form sheets of data processing and other business accounting machines are of a relatively large dimension having closely spaced perforations along opposite edges for machine tracking purposes and are typically bound between covers and employ flexible posts which utilize the edge perforations.

U.S. Pat. Nos. 3,628,877 to Barnes, Jr., and 3,957,321 to Rose pertian to a compression mechanism and post binder which utilizes compression members on either side of the perforated sheets through which a flexible post is first inserted and then bent over and secured by a retaining slide. The flexible post must be bent flat in the center of the channel of the compression members in order to reach the groove in the slide as the retaining slide is moved over the post. In both cases, the operator must attempt to hold the bent over flexible post in the center of the channel of the compression member when sliding the retaining slide over the post. If the post is not kept in the center, the post will not be secured in the slot formed by the webbing and channel of the compression bar. Instead, it will stop at the webbing of the slide while the operator attempts to thread the post through the slot.

BRIEF SUMMARY OF THE INVENTION

The invention consists of an improved slide retainer for use in a flexible post binder. A plurality of sheets are joined together by means of a pair of flexible posts extending through perforations in the sheets at the side margins thereof, and a compressor bar is fitted over the posts through corresponding holes. The compressor bars are formed from a metal strip having a central web which joins a pair of parallel rails which form slideways for slide members. The slide members each comprise a central web portion from which a pair of opposed side members depend, oriented substantially perpendicular to the web portion of the slide and spaced for slidable engagement of the compressor bar rails. Retaining members are formed integrally with the side members and extend substantially perpendicular from the side members and parallel to the web portion. A pair of opposed inner side members formed integrally with the web portion extend substantially perpendicular to the web portion and are spaced to slidably engage the channel formed by the rails of the compressor bars.

The opposed inner side members are formed such that both ends of each slide member have a conical or funnel shaped input into the slot formed between the inner side members and compression bar channel. The outer edges of the inner side members thus conform closely to the rails themselves, rather than merely forming a slot for the flexible post.

The operator merely has to bend the flexible post into the channel of the compression bar and slide the improved slide retainer over the post to create the frictional fit. Because the edges of the inner side members flare outward, a "guide groove" is formed that urges the post into the desired orientation for insertion into the slot. This feature is especially advantageous in systems where the tip of the flexible post has a sharp point, because the use of the guide groove may lessen the chances of an operator stabbing his finger.

BRIEF DESCRIPTION OF THE DRAWINGS

A detailed description of a preferred embodiment of the invention is hereafter described with specific reference being made to the drawings in which.

DETAILED DESCRIPTION OF THE INVENTION

Figure 2:
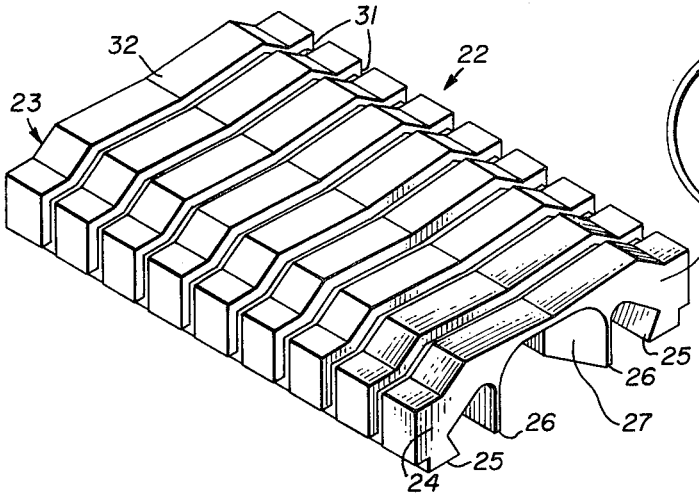
FIG. 2 is a perspective view of the retaining slide element in accordance with the present invention.
Figure 4:
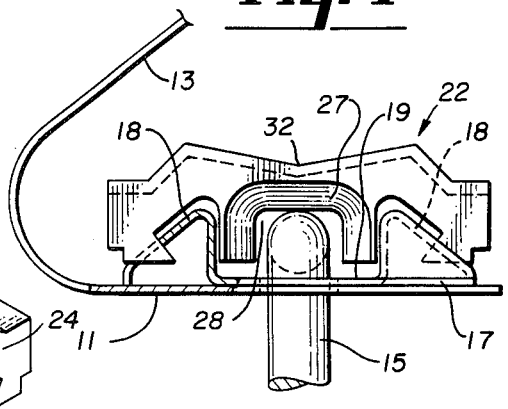
FIG. 4 is an end view of the compression mechanism and retaining slide element with the flexible post in position.
Figure 3:
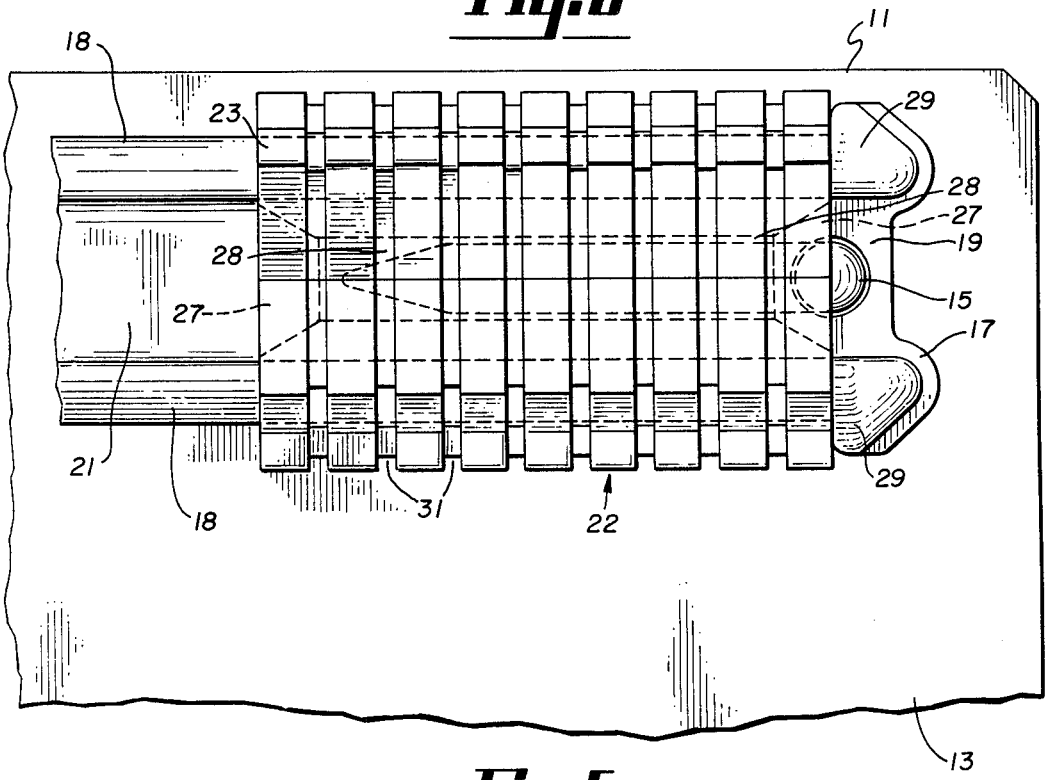
FIG. 3 is a top view of the compression mechanism and retaining slide element with the flexible post of the invention shown in phantom outline.
Figure 5:
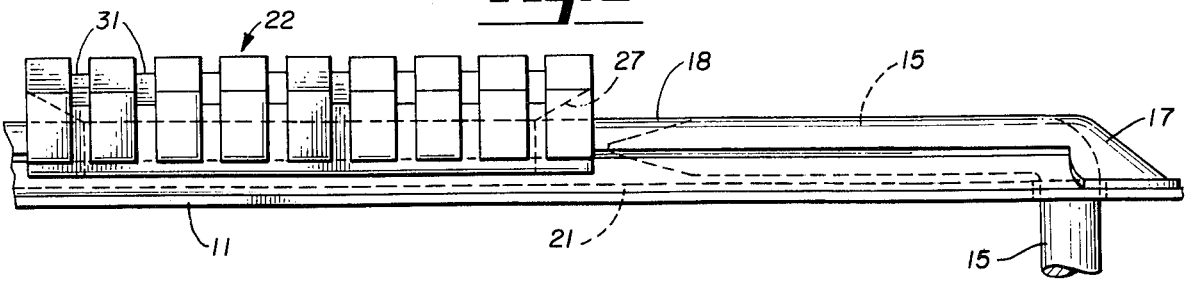
FIG. 5 is a side view of the data binder including the novel retaining slide element with a flexible post ready for engagement.
Figure 1:
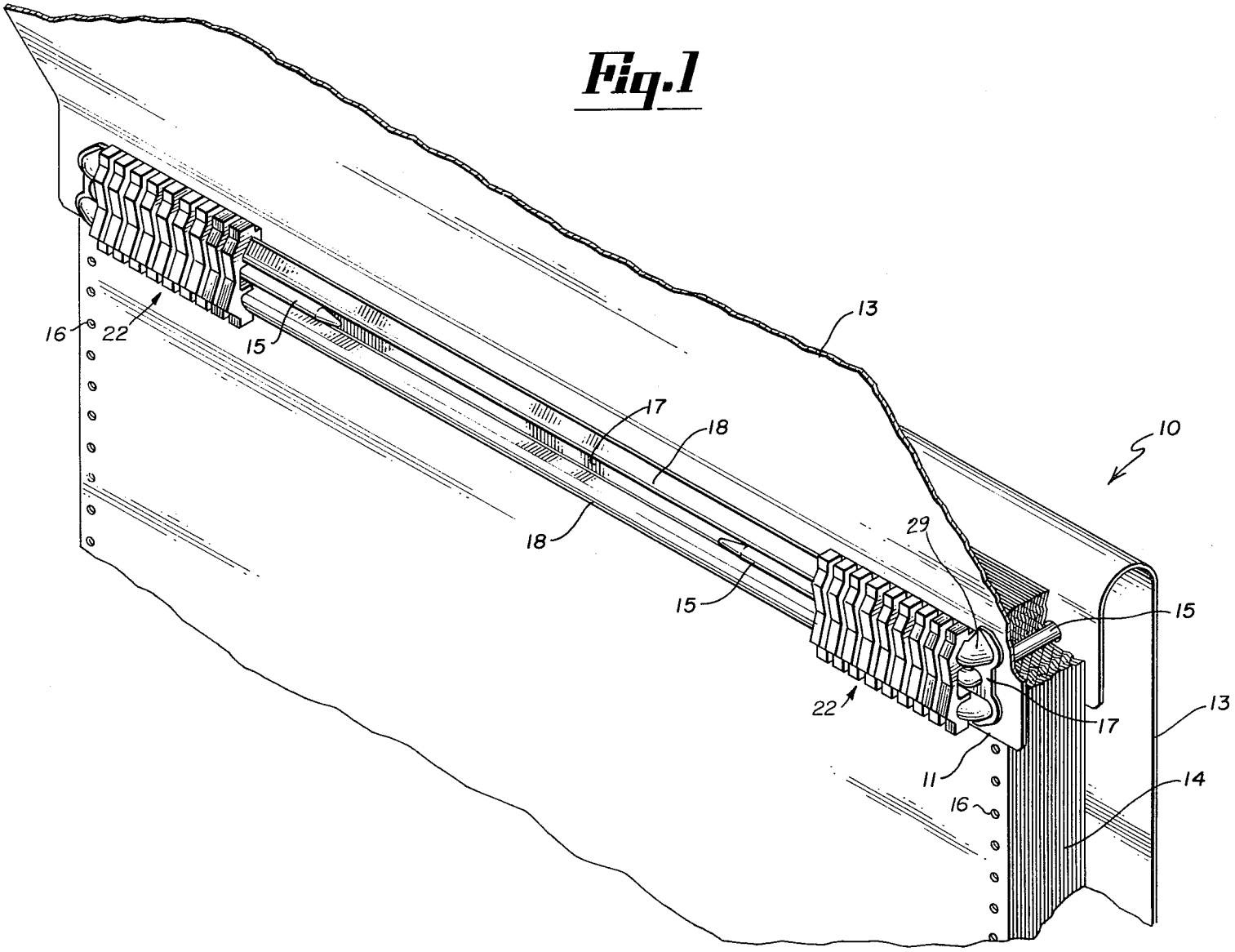
FIG. 1 is a perspective view of the data binder including the novel retaining slide elements.

Referring now to the preferred form of the structure shown in FIGS. 1 through 5, the structure is shown associated with a file folder, generally indicated at 10, which comprises front and back covers 11, 12 respectively, each having an attached flap 13 hingedly connected thereto. A stack of sheets 14 is arranged between flaps 13 and is secured therebetween by bendable posts 15, preferably made from a suitable plastic material, such as nylon. These posts pass through marginal apertures in the sheets and through registering holes 1 through the flaps and through compressor means or bars 17 which are laid over said flaps. The projecting ends of the posts 15 are bent flush against the compressor bar.

The compressor bar 17 is preferably fabricated from metal and includes a pair of laterally spaced longitudinal upstanding rails 18 which project above the web of the compressor bar. These rails define a longitudinal channel 21 between them which receives the bent down distal portions of post 15, and also define guide tracks along which retaining elements 22 are slidable.

The retaining slide elements 22 preferably are fabricated from tough plastic material. As shown, one such element is provided adjacent each end of the compressor bar. Each slide element 22 comprises a rectangular body portion including a web 23 which overlies and bridges channel 21. Each slide 22 also includes downwardly depending side portions 24 which include inwardly directed flanges 25 for engaging the rails 18 to provide slidable engagement of element 22 on compressor bar 17.

The bottom face of each retaining slide element 22 is formed with a pair of longitudinally extending ribs 26 spaced apart a distance adequate relative to the diameter of post portion 15 for assuring loose engagement of the underlying post portion 15 thereby insuring that it is retained within channel 21 of compressor bar 17. Preferably, ribs 26 ride on the inside wall of the track or rail 18 and thereby afford added strength to the mounting.

Each retaining slide element 22 is formed such that longitudinally extending ribs 26 on each end of the slide element are cut or flared from a close spacing to a wide entrance funnel 27 in the groove 28 between the longitudinally extending ribs 26. The flare 27 is formed such that longitudinally extending ribs 26 at each end of the slide element 22 are very narrow forming what amounts essentially to a knife edge against the edge of rails 18. The web portion 23 that bridges and overlies channel 21 is also cut away and thinned at each end of slide element 22. The result is a retaining slide element 22 with a center groove 28 between longitudinally extending ribs 26 having a substantially greater opening at each end.

Each end of rail 18 is deformed outwardly so as to provide a stop 29 to prevent the retaining slides 22 from sliding off the compressor bar. The top surface of web 23 preferably is formed with lateral depressions 31 and a V-shaped trough 32 to facilitate finger engagement with the retaining slide for manually sliding it along the compressor bar.

In operation, the retaining slide elements 22 are snapped onto the compression bar 17. Sheets 14 with perforations are placed between the flaps 13 and secured by bendable posts through the sheets and the registering holes 16 in the flaps and compressor bars. The operator manually bends post 15 generally into longitudinal channel 21 and slides retaining slide element 22 toward the post and is smoothly directed into the center groove 28 by the action of funnel 27, thereby securing the binder together. The groove 28 between the longitudinally extending ribs 26 must be wide and deep enough for the post 15 to enter, but the best frictional fit occurs when the width and depth of groove 28 is less than twice the width of the post 15 diameter.

The flare or funnel 27 allows the operator to insert the post 15 into the groove 28 of the retaining slide element 22 without the need to position the post 15 in the exact center of the channel 21. Also, it allows groove 28 to be smaller than would otherwise be feasible so as to provide a closer fit to post 151, resulting in a more secure data binder.

In considering this invention, it should be understood that the above disclosure is illustrative only, and the scope of the invention is to be determined by the appended claims.

What is claimed is:

1. A data binder for receiving and retaining a plurality of sheets having holes punched therein, comprising: a pair of elongated compressor bars including a rail on each longitudinal edge thereof defining a longitudinal channel therebetween, said compressor bars having at least two holes formed therebetween and spaced for engagement with at least two holes of said plurality of sheets; at least one pair of flexible posts, each of which is constructed and arranged for insertion through one of said holes and for alignment with the channels; and at least one slide member slidably mounted on the compressor bars, said slide member having a body with two ends including web portion means for bridging the channel and for slidably engaging the longitudinal rails, said web portion means each also having a pair of longitudinally extending downwardly depending spaced apart ribs defining a post receiving groove in contact with said channel, said groove being flared out at each end of said slide member such that the outer ends of the groove are substantially larger than the central portion of the groove, said flared post receiving grooves each providing a guide for an end of said flexible posts.

2. The slide member of claim 1 wherein the width of the central portion of said groove is less than twice the diameter of said flexible posts and said width is slightly larger than the diameter of said flexible posts so as to receive same.

3. The slide member of claim 2 wherein said flared portion of said post receiving groove widens from the groove width to substantially the entire width of said channel.

* * * * *